US007347740B2

(12) United States Patent
Minich

(10) Patent No.: US 7,347,740 B2
(45) Date of Patent: Mar. 25, 2008

(54) MECHANICALLY ROBUST LEAD FRAME ASSEMBLY FOR AN ELECTRICAL CONNECTOR

(75) Inventor: Steven E. Minich, York, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/284,020

(22) Filed: Nov. 21, 2005

(65) Prior Publication Data

US 2007/0117460 A1 May 24, 2007

(51) Int. Cl.
*H01R 13/405* (2006.01)

(52) U.S. Cl. ..... 439/736; 439/608

(58) Field of Classification Search ..... 439/608, 439/736

See application file for complete search history.

(56) References Cited

U.S. PATENT DOCUMENTS

| | | | | |
|---|---|---|---|---|
| 6,027,381 | A | 2/2000 | Lok | 439/736 |
| 6,042,394 | A * | 3/2000 | Mitra et al. | 439/80 |
| 6,206,735 | B1 | 3/2001 | Zanolli | 439/736 |
| 6,290,552 | B1 | 9/2001 | Saito et al. | 439/736 |
| 6,361,376 | B1 | 3/2002 | Onoda | 439/736 |
| 6,431,921 | B2 | 8/2002 | Saito et al. | 439/736 |
| 6,602,095 | B2 | 8/2003 | Astbury, Jr. et al. | 439/608 |
| 6,652,318 | B1 * | 11/2003 | Winings et al. | 439/608 |
| 6,692,272 | B2 * | 2/2004 | Lemke et al. | 439/108 |
| 2001/0046816 | A1 | 11/2001 | Saito et al. | 439/736 |
| 2002/0106932 | A1 | 8/2002 | Holland et al. | 439/500 |
| 2005/0026503 | A1 | 2/2005 | Trout et al. | 439/608 |
| 2007/0021002 | A1 * | 1/2007 | Laurx et al. | 439/608 |

* cited by examiner

*Primary Examiner*—Javaid H. Nasri
(74) *Attorney, Agent, or Firm*—Woodcock Washburn LLP

(57) ABSTRACT

A lead frame assembly is disclosed in which holes may be formed in contacts of the assembly and a dielectric material extends along a length of the contact. The dielectric material may be further secured to the contact by filling the hole. The dielectric material may span across two or more contacts of the lead frame assembly and also across gaps formed between the contacts, or may span across an entire side of a lead frame assembly. The dielectric material may add mechanical strength and robustness to the lead frame assembly while helping to reduce dust accumulation on electrical contacts of the assembly. The dielectric material may abut only one side of one or more contacts in the lead frame assembly and thus may not affect edge-coupling effect of contacts that form differential signal pairs.

25 Claims, 5 Drawing Sheets

MECHANICALLY ROBUST LEAD FRAME ASSEMBLY FOR AN ELECTRICAL CONNECTOR

CROSS-REFERENCE TO RELATED APPLICATIONS

The subject matter disclosed in this patent application is related to the subject matter disclosed and claimed in U.S. patent application Ser. No. 11/087,047, filed Mar. 22, 2005, now U.S. Pat. No. 6,988,902 which is a continuation of U.S. patent application Ser. No. 10/294,966, filed on Nov. 14, 2002, now U.S. Pat. No. 6,976,886 which is a continuation-in-part of U.S. Pat. Nos. 6,652,318 and 6,692,272. The contents of each of the above-referenced U.S. patents and patent applications are herein incorporated by reference in their entireties.

FIELD OF THE INVENTION

The invention relates to electrical connectors. More particularly, the invention relates to a mechanically robust lead frame assembly for electrical connectors.

BACKGROUND OF THE INVENTION

An electrical connector such as the electrical connector 50 shown in FIG. 1 may include a housing 55 and one or more modular lead frame assemblies 100. The lead frame assembly 100 is also shown in FIG. 2. Each lead frame assembly 100 may be an insert molded lead frame assembly. The lead frame assembly 100 may include an electrically insulating lead frame housing 108 through which contacts 104 extend. The lead frame housing 108 may be made of a dielectric material such as plastic. The lead frame assembly 100 may be constructed from as little material as possible, and the contacts 104 may be insulated from one another using air as a second dielectric. The use of air may provide for a decrease in cross-talk and for a low-weight connector, as compared to a connector that uses a heavier dielectric material throughout. However, such a connector may not be readily installed using standard flat rock tooling.

SUMMARY OF THE INVENTION

The present invention, through the arrangement of solid and air dielectrics, may allow standard flat rock tooling to be used to install the connector on a PCB. A lead frame assembly is disclosed in which holes are formed in one or more contacts of the assembly. A dielectric material, such as plastic, may be formed along a length of the contact and may be secured to the contact by filling the holes. The dielectric material may span across two or more contacts of the lead frame assembly and also across gaps between the contacts. In alternative embodiments, the dielectric material may span across an entire side of a lead frame assembly. The dielectric material may add mechanical strength and robustness to the lead frame assembly and thus to the connector. In alternative embodiments, the dielectric material may abut one side of one or more contacts in the lead frame assembly and not fill or otherwise enter any gap located between contacts. In this way, the dielectric material may not affect any edge-coupling of contacts that form differential signal pairs. In further embodiments, the dielectric material abuts opposing sides of the contact, also without entering any gap between contacts. For example, the dielectric material may be formed along a length of a contact, may fill a hole formed in the contact, and may additionally form a retaining cap (e.g., a mushroom or button cap) on the opposing side of the contact. The retaining cap may help hold the dielectric material to the contact or to the lead frame assembly.

DETAILED DESCRIPTION OF ILLUSTRATIVE EMBODIMENTS

Figure 3:
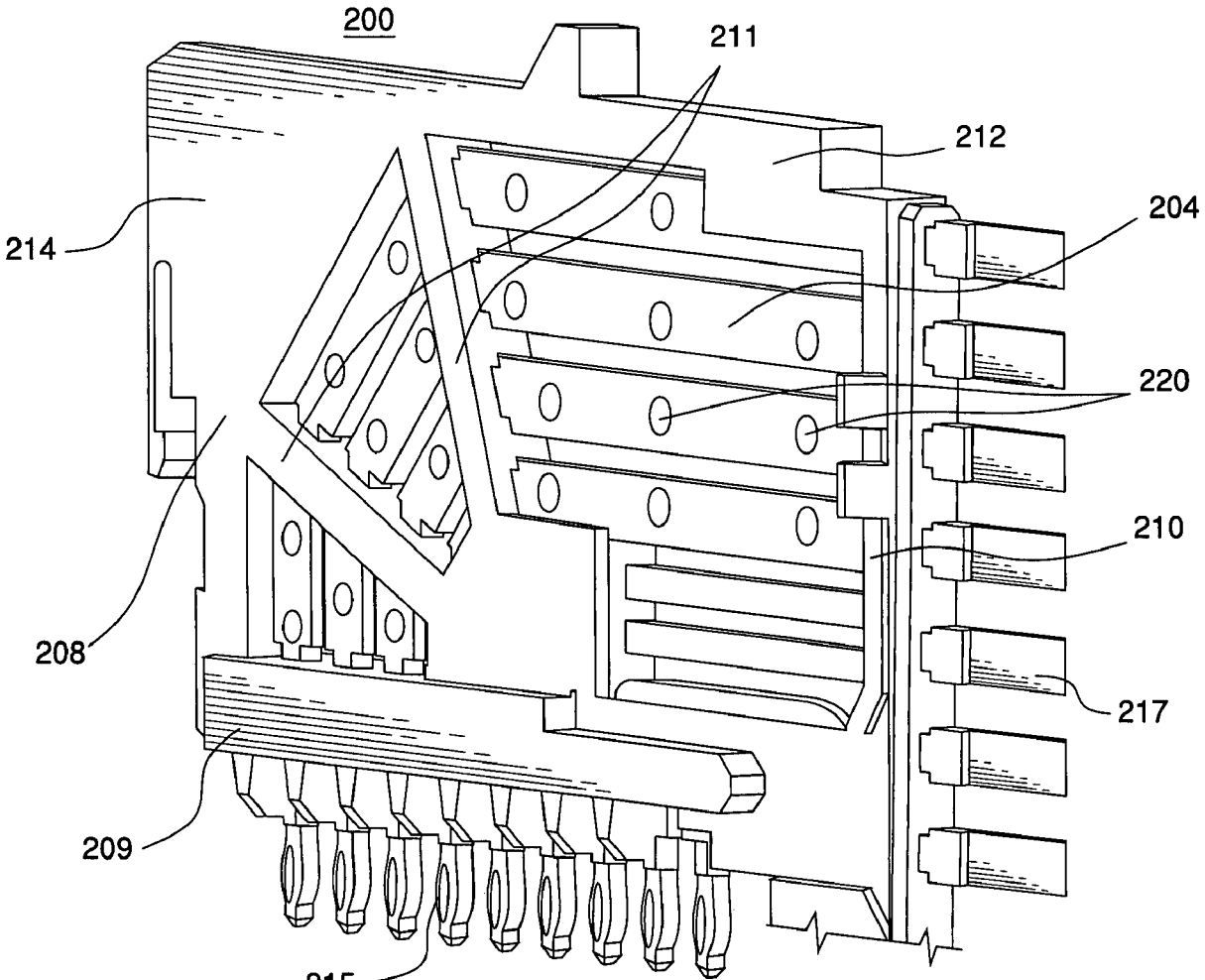
FIG. 3 is a perspective view of an example lead frame assembly with holes formed in contacts of the assembly.

FIG. 3 is a perspective view of an example lead frame assembly 200. The lead frame assembly 200 includes a lead frame housing 208. The lead frame housing 208 may be made of a dielectric material such as plastic. The lead frame housing 208 may be made by insert molding or by any other suitable method. The lead frame housing 208 may include a terminal frame component 209 and a mating frame component 210. The lead frame housing 208 additionally may include supporting frames 211 that extend across a middle cavity of the lead frame housing 208. The lead frame housing 208 additionally may include a top frame 212 and a back frame 214 that, along with the terminal frame component 209 and the mating frame component 210 define a perimeter of the lead frame housing 208.

The lead frame assembly 200 may include any number of contacts 204. The contacts 204 may be signal contacts used in either single-ended or differential transmission. In alternative embodiments, the contacts 204 also may be selectively designated as signal or ground contacts. The contacts 204 may extend through the terminal frame component 209 and each contact 204 may have a terminal end 215. The terminal ends 215 may be for engagement with an electrical device such as, for example, a printed circuit board (PCB). The terminal ends 215 may be compliant terminal ends or could be any type of terminal end suitable for any surface-mount or through-hole application. The contacts 204 may extend through the mating frame component 210, and each contact 204 may have a mating end 217. The mating ends 217 of the contacts 204 may be for mating with complementary receptacle contacts of a second electrical connector (not shown).

The contacts 204 may be blade contacts and may have a generally rectangular cross-section. Additionally, the contacts 204 may be spaced apart within the lead frame housing 208 so that an edge-coupling effect is created. Edge-coupling may occur between contacts 204 of differential signal pairs when an edge of one contact 204 is adjacent to an edge of an adjacent contact 204. Less cross talk may occur where adjacent contacts are edge-coupled than where adjacent contacts are broad-side-coupled (i.e., where a broad-side of one contact is adjacent to a broad-side of an adjacent contact). Additionally, the tighter the edge-coupling, the less the coupled-signal-pair's electrical field may extend towards an adjacent pair. In addition to improving cross-talk qualities of an electrical connector, edge-coupling contacts also may improve impedance characteristics of the connector. For example, a gap of about 0.3-0.4 mm between edge-coupled contacts 204 may be adequate to provide an impedance of about 100 ohms, while a gap of about 1 mm may be necessary when the same contacts are broad-side-coupled to achieve the same impedance. Edge coupling is further described in U.S. Pat. No. 6,988,902.

One or more of the contacts 204 may define one or more holes 220 extending through the respective contact 204. In rectangular-shaped contacts having two opposing broad sides and two opposing edges, the holes 220 may extend from a broad side of the contact 204, through the respective contact 204, to the opposing broadside of the contact 204. The holes 220 may be made in the contacts 204 by any suitable method, such as by stamping. The contacts may be stamped from a sheet of conductive material. Stamping of the holes may be completed before, simultaneously with, or after the contacts 220 are formed. The holes 220 in the contacts 204 may be stamped before or after the lead frame housing 208 is insert-molded onto the lead frame. As described herein, the holes 220 may facilitate holding a dielectric material onto the respective contacts 204.

Figure 2:
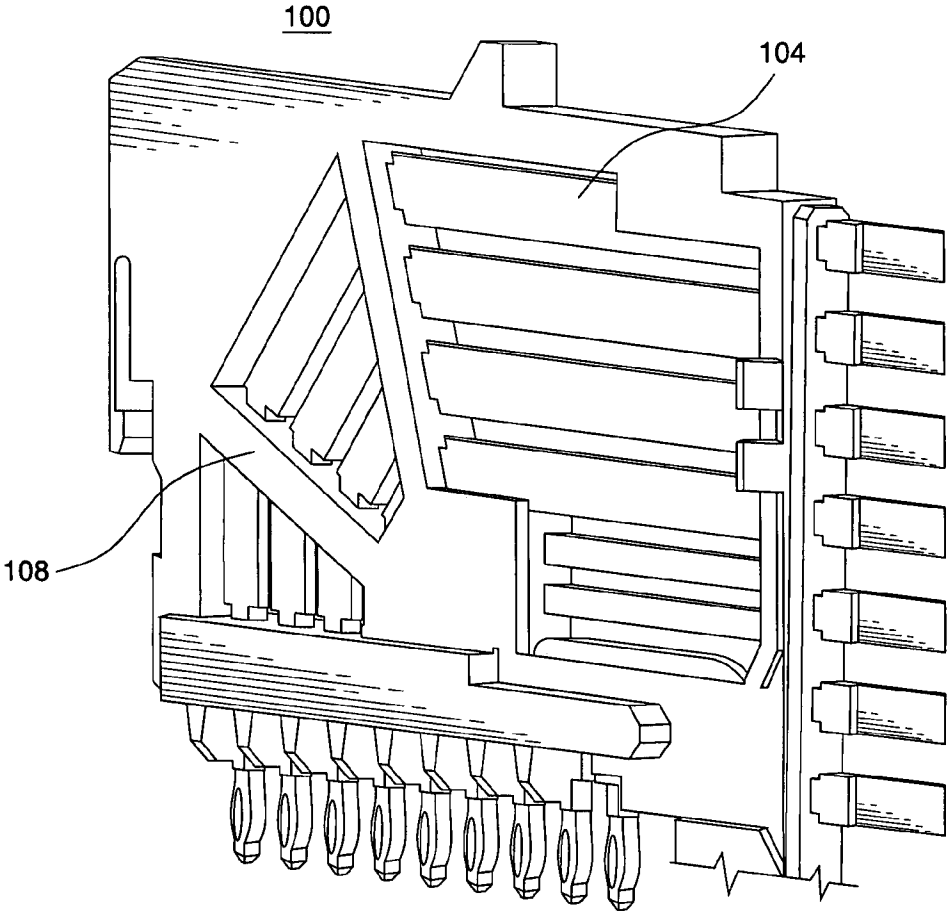
FIG. 2 PRIOR ART
FIG. 2 is a perspective view of a prior art lead frame assembly.
Figure 4A:
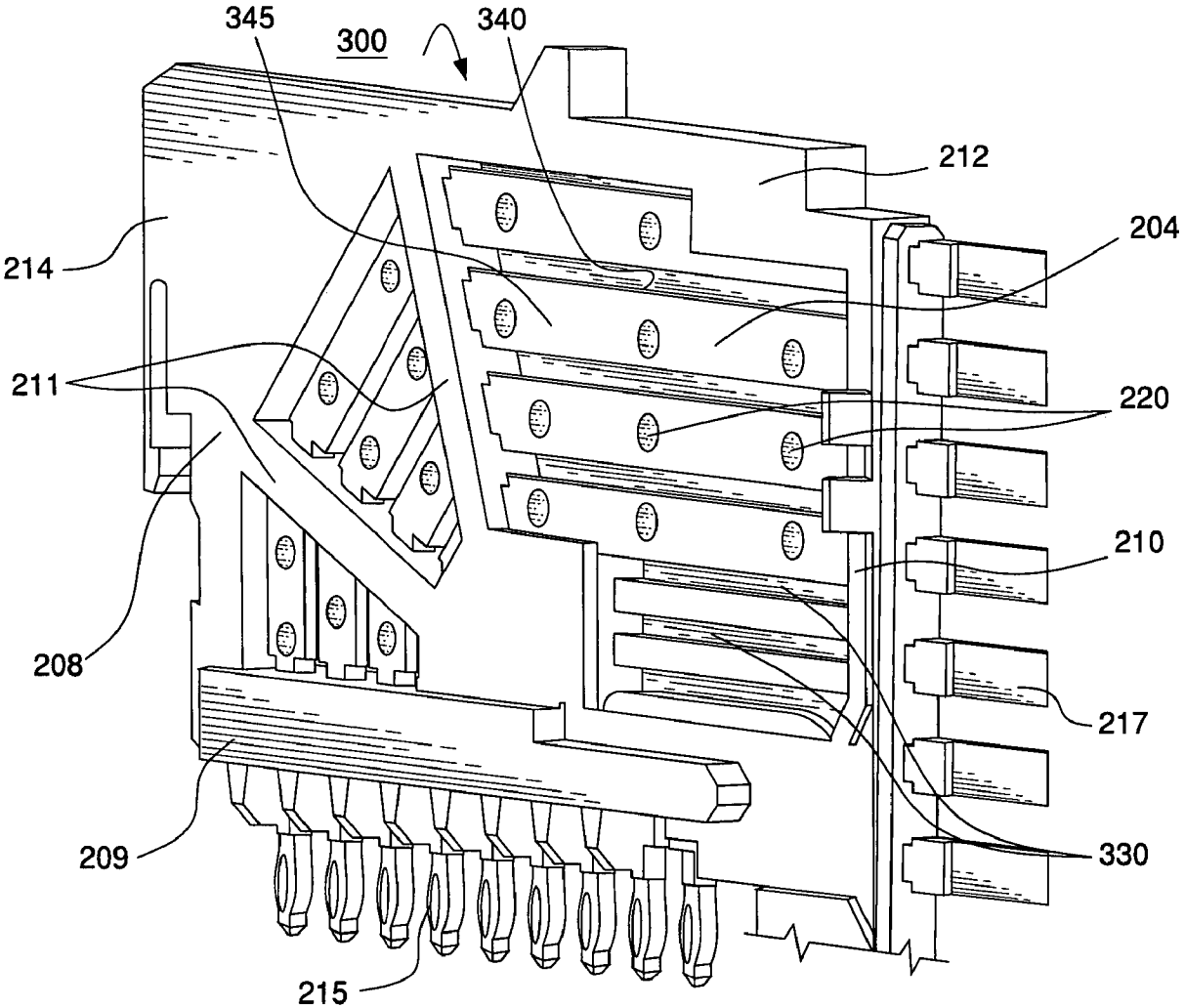
FIGS. 4A and 4B are perspective views of an example lead frame assembly after over molding with a dielectric on one side.
Figure 4B:
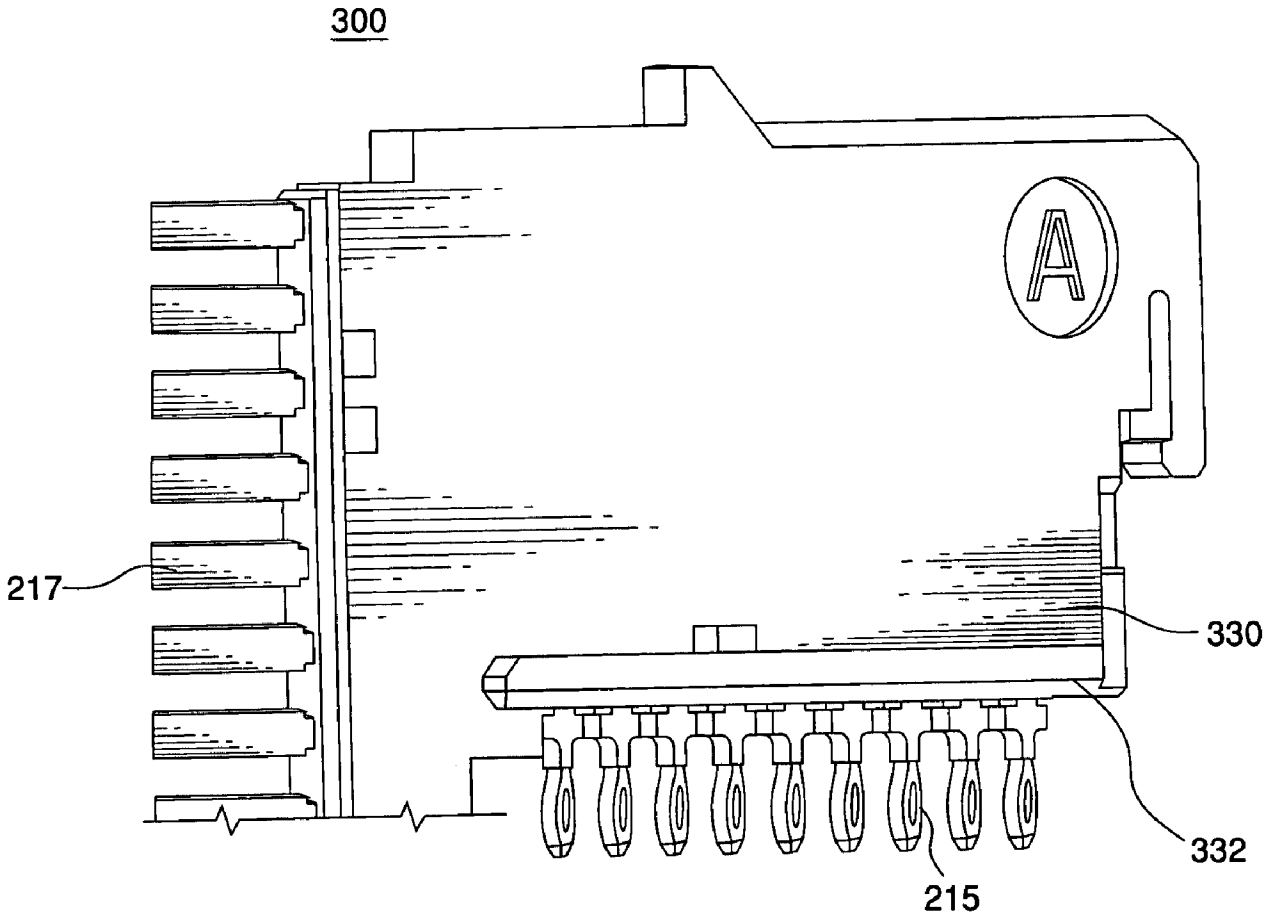

FIGS. 4A and 4B are perspective views of a lead frame assembly 300 with a dielectric material 330 attached. The dielectric material may be a plastic such as liquid crystal polymer (LCP), high temperature nylon (HTN), or other suitable materials. The dielectric material 330 may be molded onto the lead frame assembly 200 (FIG. 2) after the lead frame assembly 200 is manufactured. Alternatively, the dielectric material 330 may be molded as part of the lead frame housing 208 when the lead frame housing is molded.

Figure 1:
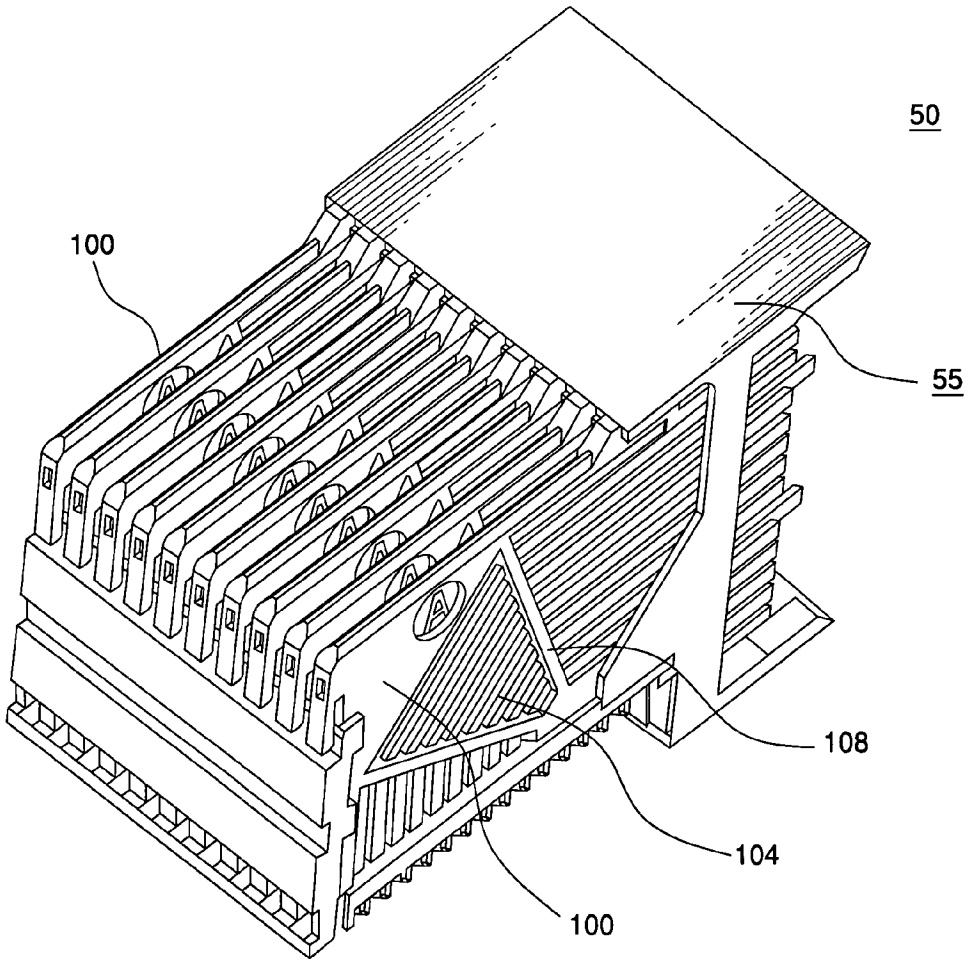
FIG. 1 PRIOR ART
FIG. 1 is a perspective view of a prior art electrical connector.

The lead frame assembly 300 may be used in an electrical connector such as depicted in FIG. 1. The lead frame assembly 300 may be modular, and constructed to specified dimensions for flexible and/or varied use. Thus it may be used in the electrical connector 50 alone or in conjunction with other modular lead frame assemblies 300 or lead frame assemblies 100 (FIG. 2), for example. Additionally, while the lead frame assembly 300 may be used in a right-angle connector, embodiments of the invention are envisioned for other types of connectors such as, for example, mezzanine connectors.

The first dielectric material 330 may fill the holes 220 in the contacts 204, which may aid in holding the material 330 to the lead frame assembly 300. In one embodiment and as shown in FIG. 4A, the dielectric material 330 may fill the holes 220 and may abut the side 340 of the contacts 204. The dielectric material 330 may be formed so that it does not enter or fill the gaps, that is, space, between adjacent contacts 204, leaving the gaps filled with a second dielectric material such as air. The dielectric material 330 likewise may be formed so that it does not abut the side 345 of the lead frame assembly opposite the side 340. In this way, while the dielectric material 330 may add strength, mechanical robustness, and/or resiliency to the lead frame assembly 100 (FIG. 2), the material 330 may be formed so that it does not affect the edge-coupled characteristics of the lead frame assembly 100. The increased mechanical strength may enable a connector comprising one or more lead frame assemblies 300 to be connected to a substrate without bending the assembly 300, its lead frame housing 208, or its contacts 204. Thus, for example, a flat rock application tool may be used to connect the lead frame assembly 300 to a substrate without causing bending of the connector or its components.

In addition to improving mechanical strength, the addition of the dielectric material 330 may also help reduce dust formation on the contacts within the gaps, as dust will be prevented from accumulating from the side 340 of the lead frame assembly 300.

FIG. 4B depicts the side 340 of the lead frame assembly 300. That is, FIG. 4B shows the "back" side or side opposite that shown in FIG. 4A. As shown in FIG. 4B, the dielectric material 330 forms a substantially uniform surface, covering all of the contacts 204. The lead frame assembly 300 additionally may include a protrusion 332 that may be used to retain the lead frame assembly 300 in a connector housing.

In an another embodiment, the dielectric material 330 may abut contacts on the side 340 of the lead frame assembly 300 and also fill the one or more holes 220 of the contacts 204. Additionally, the dielectric material 330 may be molded to form a retaining cap (e.g., a mushroom or button cap) over one or more of the contact holes 220 on the side 345 of the lead frame assembly 300. These retaining caps may help retain the material to the lead frame assembly 300. Additionally, it will be recognized that, while embodiments have been described with regard to electrical contacts having a rectangular cross-section and with regard to edge-coupled contacts, alternative embodiments are also envisioned. For example, contacts may have a round or square cross-section or may be broad-side coupled.

Further, alternative embodiments are envisioned in which the dielectric material 330 abuts only one or a few contacts of a lead frame assembly. Also, the dielectric material 330 may be adhered to or made to abut one or more contacts of a lead frame assembly without the use of holes in the contacts. For example, such dielectric material may be molded over the top and/or the bottom of a contact, a lead frame assembly, and/or an electrical connector.

Moreover, it is to be understood that the foregoing illustrative embodiments have been provided merely for the purpose of explanation and are in no way to be construed as limiting of the invention. Words which have been used herein are words of description and illustration, rather than words of limitation. Additionally, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. A lead frame assembly for an electrical connector, comprising:

an electrical contact defining a first side, a second side opposite the first side, and a hole extending from the first side to the second side; and a first dielectric material positioned adjacent the first side of the electrical contact and in the hole and a second dielectric material positioned adjacent the second side of the electrical contact;

wherein the first dielectric material and second dielectric material are different, and at least a portion of the first dielectric material is positioned opposite at least a portion of the second dielectric material.

2. The lead frame assembly of claim 1, further comprising:

a lead frame housing comprising a terminal frame component and a mating frame component, wherein a portion of the length of the electrical contact extends from the terminal frame component to the mating frame component, and wherein the first dielectric material extends the length of that portion of the electrical contact.

3. The lead frame assembly of claim 2, wherein the electrical contact extends through the terminal and mating frame components.

4. The lead frame assembly of claim 1, wherein the electrical contact further defines a third side and a fourth side opposite the third side, and wherein the third and fourth sides are each devoid of the first dielectric material.

5. The lead frame assembly of claim 4, wherein the electrical contact defines a rectangular cross-section and wherein, in cross-section, the first and second sides are longer than the third and fourth sides.

6. The lead frame assembly of claim 1, wherein the electrical contact is devoid of the first dielectric material on at least one of the first and second sides.

7. The lead frame assembly of claim 1, wherein the first dielectric material fills the hole.

8. The lead frame assembly of claim 1, wherein the first dielectric material forms a retaining cap over the hole on at least one side of the electrical contact.

9. The lead frame assembly of claim 1, wherein the lead frame assembly is modular.

10. The lead frame assembly of claim 1, wherein the lead frame assembly is adapted to be received into a right-angle connector housing.

11. The lead frame assembly of claim 1, wherein the lead frame assembly is adapted to be received into in a mezzanine-style connector housing.

12. An electrical connector, comprising:

a connector housing; and a lead frame assembly received in the connector housing and comprising, first and second electrical contacts received in the lead frame assembly, wherein the first and second electrical contacts are adjacent to each other and a gap is defined between the first and second electrical contacts, and a first dielectric material positioned adjacent at least a first side of the first and second electrical contacts and extending across the gap and a second dielectric material positioned adjacent a second side of the first and second electrical contacts opposite the first side, wherein the first dielectric material and second dielectric material are different, and at least a portion of the first dielectric material is opposite at least a portion of the second dielectric material.

13. The electrical connector of claim 12, wherein each of the first and second electrical contacts defines a respective first side and a respective second side opposite the first side thereof, wherein the first electrical contact further defines a hole extending from the first side thereof to the second side thereof, and wherein the first dielectric material is disposed in the hole.

14. The electrical connector of claim 13, wherein each of the first and second electrical contacts further defines a respective third side and a respective fourth side opposite the third side thereof, and wherein the first and second electrical contacts are devoid of the first dielectric material on the third and fourth sides thereof.

15. The electrical connector of claim 14, wherein the first and second electrical contacts are devoid of the first dielectric material on the second sides thereof.

16. The electrical connector of claim 13, wherein the lead frame assembly further comprises a lead frame housing comprising a terminal frame component and a mating frame component, wherein a portion of the length of each of the first and second electrical contacts extends from the terminal frame component to the mating frame component, and wherein the first dielectric material extends the length of that portion of the first electrical contact.

17. An electrical connector comprising:

a lead frame assembly comprising, a lead flame housing comprising a terminal flame component and a mating flame component, and first and second edge-coupled electrical contacts, each having a portion of its length extending from the terminal flame component to the mating flame component, wherein each of the first and second edge-coupled electrical contacts defines a respective first side and a respective second side opposite the first side thereof, and a first dielectric material positioned adjacent the first side of the first and second edge-coupled electrical contacts and a second dielectric material positioned adjacent the second side of the first and second edge-coupled electrical contacts;

wherein the first dielectric material and second dielectric material are different, and at least a portion of the first dielectric material is positioned opposite at least a portion of the second dielectric material.

18. The electrical connector of claim 17 wherein the first edge-coupled electrical contact defines a hole extending from the first side thereof to the second side thereof, and wherein the first dielectric material is disposed in the hole.

19. The electrical connector of claim 18, wherein each of the first and second edge-coupled electrical contacts defines a respective third side and a respective fourth side opposite the third side thereof, and wherein the third and fourth sides are devoid of the first dielectric material.

20. The electrical connector of claim 19, wherein the first dielectric material forms a retaining cap over the hole on at least one of the sides of at least one of the first and second edge-coupled electrical contacts.

21. A lead frame assembly for an electrical connector, comprising:

an electrical contact defining a first side, a second side opposite the first side, and a hole extending from the first side to the second side; and a first dielectric material positioned adjacent at least one side of the electrical contact and in the hole and a second dielectric material positioned adjacent the other side of the electrical contact;

wherein the first dielectric material forms a retaining cap over the hole on at least one side of the electrical contact.

22. An electrical connector, comprising:

a connector housing; and a lead frame assembly received in the connector housing and comprising, first and second electrical contacts received in the lead frame assembly such that a gap is defined between the first and second electrical contacts, and a first dielectric material positioned adjacent at least one side of the first and second electrical contacts and extending across the gap and a second dielectric material positioned adjacent the other side of the first and second electrical contacts;

wherein each of the first and second electrical contacts defines a respective first side and a respective second side opposite the first side thereof, wherein the first electrical contact further defines a hole extending from the first side thereof to the second side thereof, and wherein the first dielectric material is disposed in the hole; and wherein each of the first and second electrical contacts further defines a respective third side and a respective fourth side opposite the third side thereof, and wherein the first and second electrical contacts are devoid of the first dielectric material on the third and fourth sides thereof.

23. The electrical connector of claim 22, wherein the first and second electrical contacts are devoid of the first dielectric material on the second side thereof.

24. An electrical connector comprising:

a lead frame assembly comprising, a lead frame housing comprising a terminal frame component and a mating frame component, and first and second edge-coupled electrical contacts, each having a portion of its length extending between the terminal frame component and the mating frame component, wherein each of the first and second edge-coupled electrical contacts defines a respective first side and a respective second side opposite the first side thereof, and a unitary dielectric material disposed on each of the first and second edge-coupled electrical contacts, the unitary dielectric material extending said portions of said lengths of the first and second edge-coupled electrical contacts;

wherein the first edge-coupled electrical contact defines a hole extending from the first side thereof to the second side thereof, and wherein the unitary dielectric material is disposed in the hole; and wherein each of the first and second edge-coupled electrical contacts defines a respective third side and a respective fourth side opposite the third side thereof, and wherein the third and fourth sides are devoid of the unitary dielectric material.

25. The electrical connector of claim 24, wherein the unitary dielectric material forms a retaining cap over the hole on at least one of the sides of at least one of the first and second edge-coupled electrical contacts.

* * * * *